US011000737B2

(12) United States Patent
Godoy

(10) Patent No.: US 11,000,737 B2
(45) Date of Patent: May 11, 2021

(54) SWIMMING GOGGLES

(71) Applicant: Cressi-Sub S.p.A., Genoa (IT)

(72) Inventor: Carlos Alberto Godoy, Genoa (IT)

(73) Assignee: Cressi-Sub, S.P.A., Genoa (IT)

( * ) Notice: Subject to any disclaimer, the term of this patent is extended or adjusted under 35 U.S.C. 154(b) by 62 days.

(21) Appl. No.: 15/874,263

(22) Filed: Jan. 18, 2018

(65) Prior Publication Data

US 2018/0318649 A1 Nov. 8, 2018

(30) Foreign Application Priority Data

May 4, 2017 (IT) ..... 202017000048110

(51) Int. Cl.
*A63B 33/00* (2006.01)

(52) U.S. Cl.
CPC ..... *A63B 33/004* (2020.08); *A63B 33/002* (2013.01); *A63B 2209/00* (2013.01)

(58) Field of Classification Search
CPC ..... A63B 33/002; A63B 2033/004; A63B 2209/00; A63B 33/004; A61F 69/02; A61F 9/02; A61F 9/026
USPC ..... 2/426, 428, 440, 442, 446
See application file for complete search history.

(56) References Cited

U.S. PATENT DOCUMENTS 5,802,620 A * 9/1998 Chiang ..... A63B 33/002 2/428
5,857,221 A * 1/1999 Geneve ..... A63B 33/002 2/428
5,901,382 A * 5/1999 Chiang ..... A63B 33/002 2/439
6,317,897 B1 * 11/2001 Chiang ..... A63B 33/002 2/428
6,349,419 B1 * 2/2002 Chiang ..... A63B 33/002 2/428
6,349,420 B1 * 2/2002 Chiang ..... A63B 33/002 2/428
6,405,384 B1 * 6/2002 Chiang ..... A63B 33/002 2/428
6,749,299 B1 * 6/2004 Hsu ..... G02C 11/00 2/435
8,250,678 B2 * 8/2012 Sup ..... A63B 33/002 2/440

(Continued)

OTHER PUBLICATIONS

"The Online Materials Information Resource." MatWeb, www.matweb.com/errorUser.aspx?msgid=2&ckck=nocheck. (Year: NA).*

*Primary Examiner* — Heather Mangine
(74) *Attorney, Agent, or Firm* — Blank Rome LLP

(57) ABSTRACT

Swimming goggles (10) having two lenses (11), a pair of rigid frames (13) supporting the lenses, a rigid first connecting element (15) between the pair of frames (13), and a soft second element (12) distinct from the first connecting element (15) and from the frames (13). The frames (13) can have a rigidity chosen to ensure a shape of a rim of the lenses (11) and to support end buckles for connection between the goggles (10). The first connecting element (15) can have a lower rigidity than the frames (13), adapting the first connecting element (15) to a shape of a user's nasal root but opposing traction forces tending to modify a distance between the lenses (11) and the torsional torques tending to modify relative lying planes of the two lenses (11). The second element (12) can have two annular portions (16) and a connecting bridge (24) therebetween.

4 Claims, 2 Drawing Sheets

(56) References Cited

U.S. PATENT DOCUMENTS

2002/0155275 A1* 10/2002 Kobayashi ..... B32B 5/18 428/318.8
2003/0035082 A1* 2/2003 Olney ..... G02C 11/08 351/62
2005/0015863 A1* 1/2005 Chiang ..... A63B 33/002 2/442
2005/0015868 A1* 1/2005 Chiang ..... A63B 33/002 2/466
2005/0120468 A1* 6/2005 Kawashima ..... A63B 33/002 2/444
2005/0273913 A1* 12/2005 Chiang ..... A63B 33/002 2/428
2006/0218705 A1* 10/2006 Chiang ..... A61F 9/026 2/448
2007/0023961 A1* 2/2007 Pan ..... B29C 45/14311 264/273
2007/0277297 A1* 12/2007 Chiang ..... A63B 33/002 2/426
2008/0111966 A1* 5/2008 Chiang ..... A63B 33/002 351/43
2008/0143953 A1* 6/2008 Welchel ..... A41D 13/1184 351/62
2008/0189837 A1* 8/2008 Chiang ..... A63B 33/002 2/431
2009/0038060 A1* 2/2009 Chiang ..... A63B 33/002 2/440
2009/0136774 A1* 5/2009 Onogi ..... C08L 23/12 428/516
2009/0137722 A1* 5/2009 Machl ..... C08L 23/142 524/528
2009/0300828 A1* 12/2009 Chiang ..... A63B 33/002 2/428
2010/0024098 A1* 2/2010 Chiang ..... A63B 33/002 2/428
2010/0077538 A1* 4/2010 Chiang ..... A63B 33/002 2/428
2010/0319112 A1* 12/2010 Chiang ..... A63B 33/002 2/442
2011/0302702 A1* 12/2011 Chiang ..... A63B 33/002 2/442
2012/0047638 A1* 3/2012 Shiue ..... B63C 11/12 2/427
2012/0246810 A1* 10/2012 Chiang ..... A63B 33/002 2/428
2014/0013494 A1* 1/2014 Godoy ..... B63C 11/12 2/428
2015/0335742 A1* 11/2015 Vissman ..... A61K 33/24 501/105
2015/0335956 A1* 11/2015 DiChiara ..... G02C 13/00 351/43
2016/0252747 A1* 9/2016 Lortscher ..... C08J 5/18 351/104
2016/0327810 A1* 11/2016 Cross ..... G02C 9/00
2017/0266049 A1* 9/2017 Chou ..... G02C 9/00
2017/0368416 A1* 12/2017 Saumureau ..... A63B 33/002
2018/0318649 A1* 11/2018 Godoy ..... A63B 33/002
2019/0015705 A1* 1/2019 Chiang ..... A63B 33/002
2019/0054349 A1* 2/2019 Chiang ..... A63B 33/002

* cited by examiner

SWIMMING GOGGLES

RELATED APPLICATIONS

This application claims priority to Italy Application No. 2020017000048110, filed May 4, 2017. The above-identified related application is incorporated by reference.

FIELD OF USE

The present invention relates to swimming goggles, of the most well-known and widely-available type, in general comprising a support structure for the lenses, the support structure being made of a soft and elastic material, which surrounds the lenses and extends behind them in the form of a seal adapted to rest against the eye-sockets of the swimmer.

The two lateral ends of the support structure of the lenses are connected to a strap which serves to fix the goggles to the swimmer's head by means of buckles that enable regulation of its length and state of tension.

BACKGROUND OF THE INVENTION

Goggles intended for competitive swimming must have special characteristics.

Primarily, these goggles must have the smallest possible dimensions, as the dimensions thereof have a negative influence on resistance to forward motion.

Secondly, the support structure of the lenses, while enabling adaptation to the user's eye-sockets, must prevent the lenses from moving away or towards one another during use, thus remaining in the position fixed by the user by regulation of the connecting buckles between the goggles and said strap.

As the support structure of the lenses is generally made using elastic and soft material, this effect is difficult to achieve. Therefore, in a very well-known and widely available solution, the support structure of the lenses is made in two parts, the support frames for the lenses being connected to one another by a strip of non-extensible material which however is lacking in any torsional rigidity and therefore does not ensure that the initial position of the goggles in the user's eye-sockets is maintained.

SUMMARY OF THE INVENTION

The set task of the present invention is therefore to eliminate the drawbacks noted in the prior art, by realising high-performance swimming goggles that can be used in the competitive sphere.

Within the scope of this task, an object of the invention is to produce swimming goggles that are light, compact and constructionally adapted for maintaining, in use, the position fixed by the swimmer by regulation of the buckles connecting the goggles and the strap.

The set task, as well as these and other objects according to the present invention, are attained by producing swimming goggles characterised in that they comprise:

two lenses;

a pair of rigid frames for supporting the lenses, made of a material having a rigidity chosen in such a way as to ensure the shape of the rim of the lenses and to support end buckles for connection between said goggles and a support strap thereof;

a rigid first connecting element between said pair of support frames of the lenses, distinct from the support frames of the lenses and made of a material having a lower rigidity than a rigidity of said support frames of the lenses and selected in such a way as to adapt said first element to the shape of the user's nasal root but to oppose the traction forces tending to modify the distance between the lenses and the torsional torques tending to modify the relative lying planes of the two lenses;

a soft second element distinct from the first element and from said support frames of the lenses, said second element being formed by a seal comprising a pair of annular portions for resting against the eye-sockets of the swimmer and a connecting bridge between said annular portions, said pair of annular portions projecting posteriorly from the two support frames of the lenses.

Other characteristics of the present invention are further defined in the claims herein below.

BRIEF DESCRIPTION OF THE DRAWINGS

Further characteristics and advantages will become more apparent from the following detailed description of the swimming goggles according to the invention, illustrated by way of example in the accompanying FIGURES, wherein.

DETAILED DESCRIPTION OF THE ILLUSTRATED EMBODIMENTS

Figure 1:
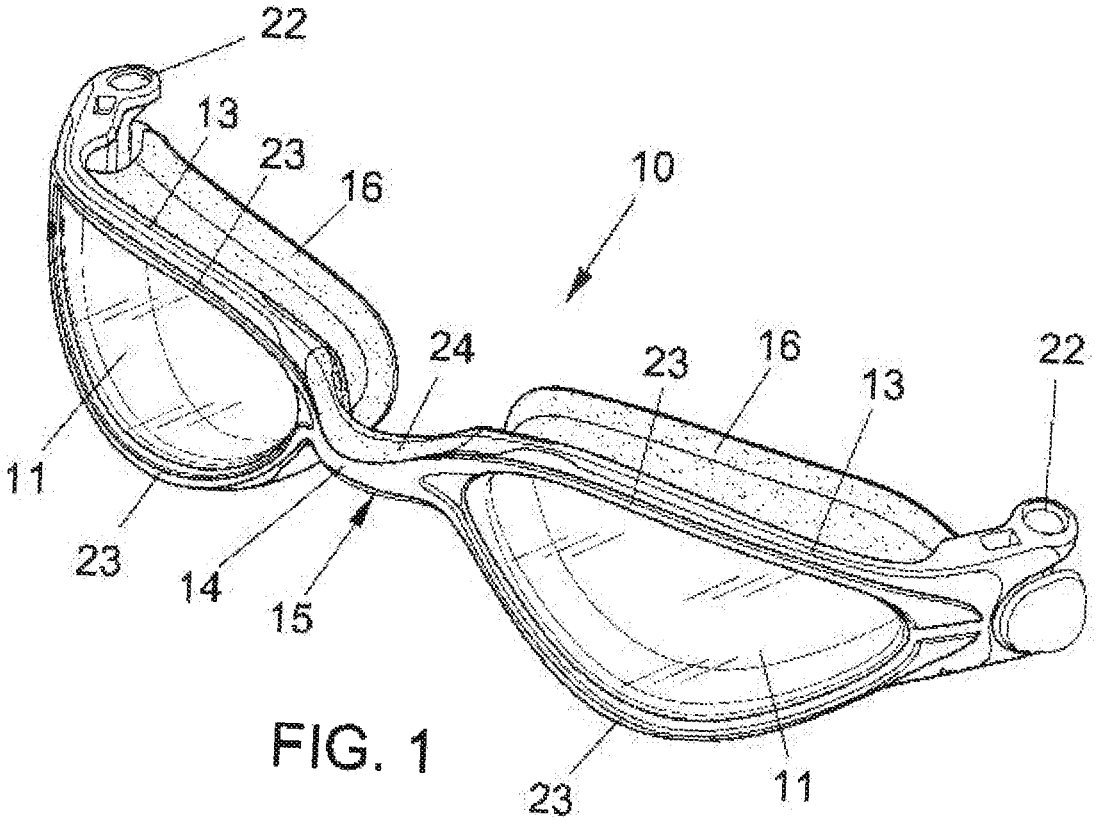
FIGS. 1-5 illustrate the swimming goggles according to the invention.
Figure 2:
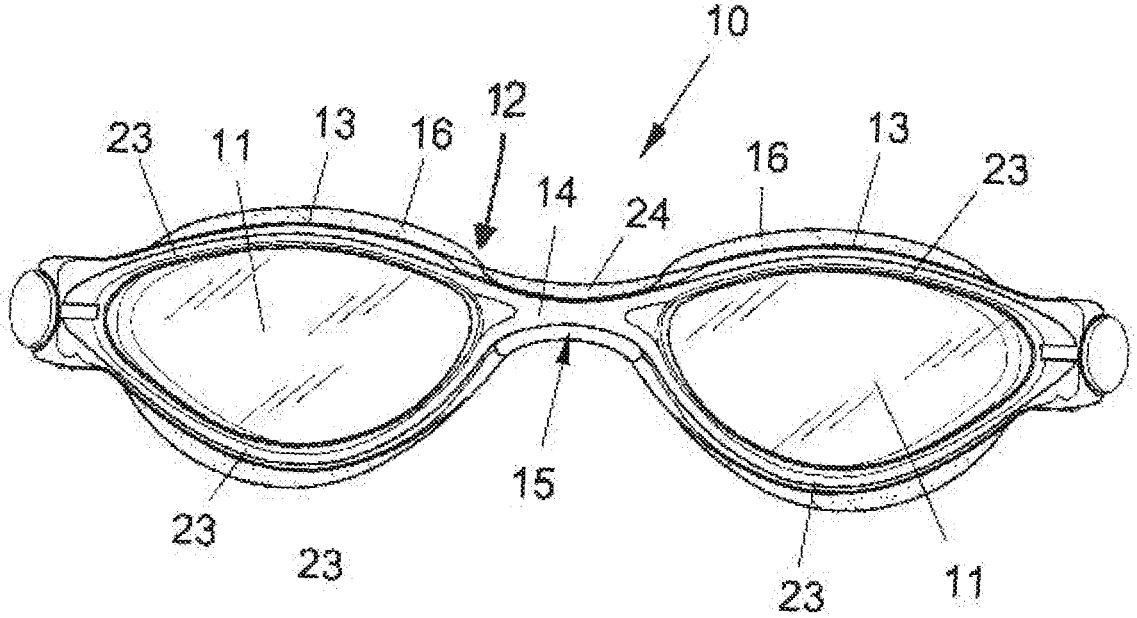
Figure 3:
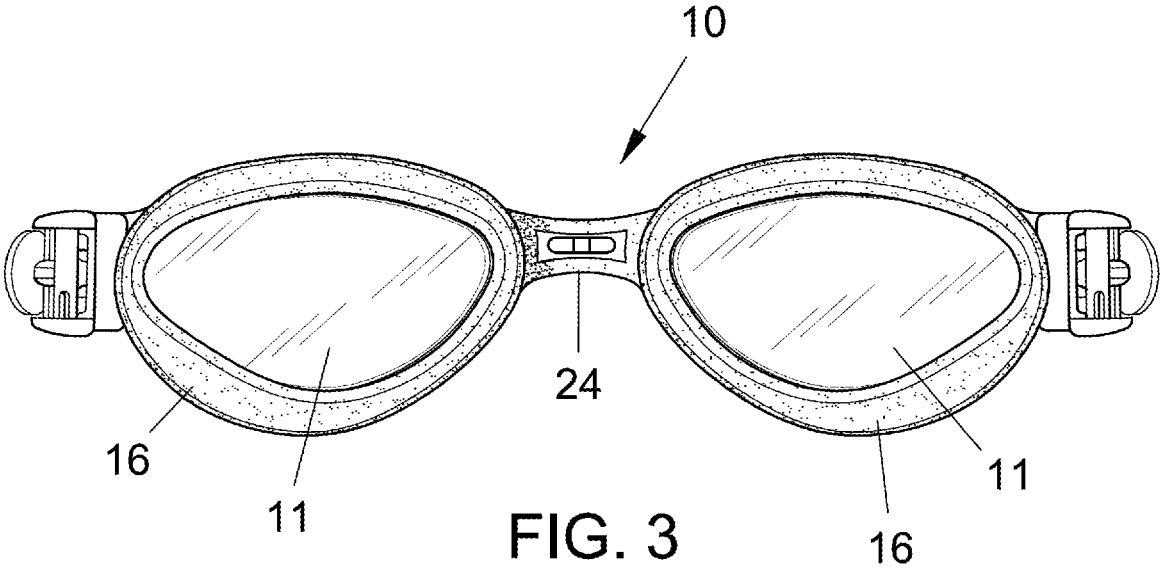
Figure 4:
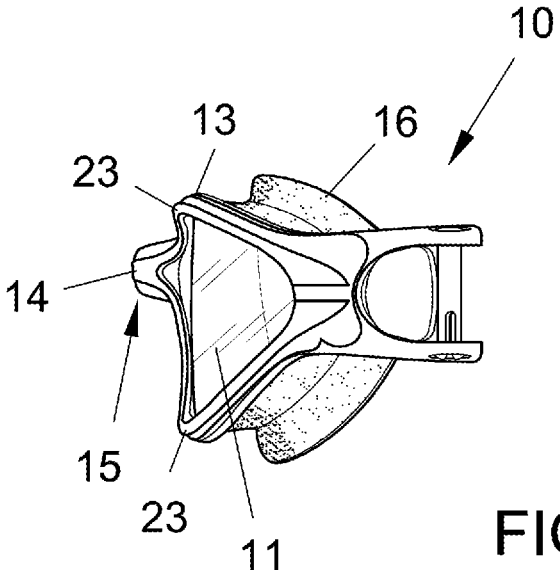
Figure 5:
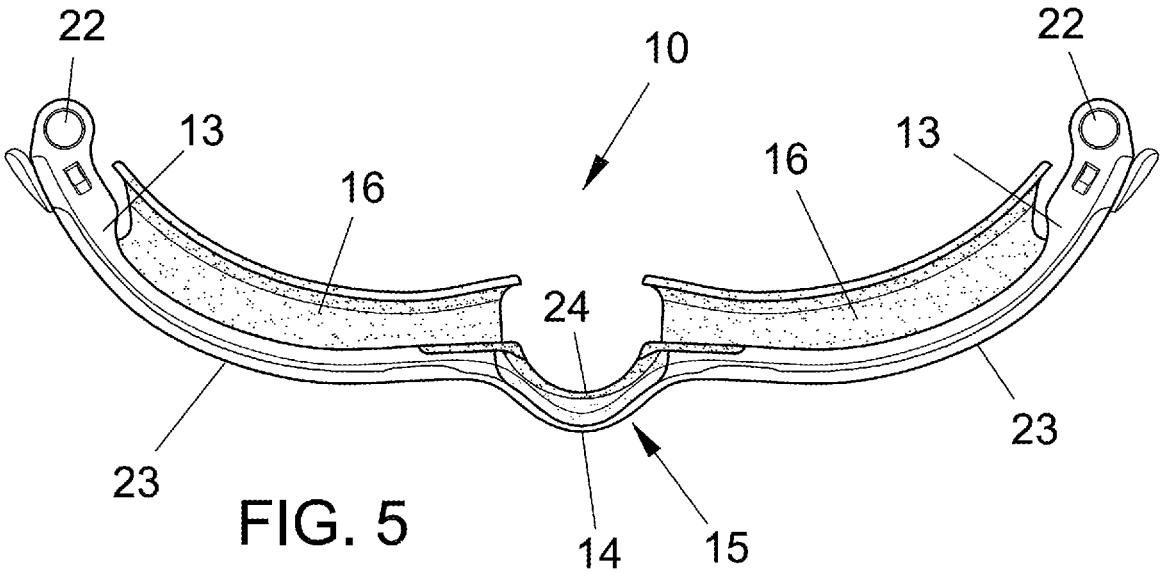

With reference to the FIGURES cited above, reference numeral 10 denotes swimming goggles in their entirety.

The swimming goggles 10 comprise two lenses 11, a pair of support frames 13 of the lenses 11, made of a relatively rigid material that is thus able to provide a fixed support for the connecting buckles of the strap by means of blocks 22, a first connecting element 15 between said pair of support frames 13 of the lenses 11 distinct from the support frames 13 of the lenses 11, made using a material having lower rigidity and a soft second element 12 distinct from the support frames 13 of the lenses 11 and from the first element 15, made using a material having lower rigidity.

Each frame 13 is formed by a ring of rigid material, congruent with the perimeter of the lens 11 for resting of the lens perimeter.

The first element 15 has a rigidity that is lower than the rigidity of the material of the support frames 13 of the lenses 11, in order to provide greater adaptability to the user's nasal root while preventing a change in the distance between the support frames of the lenses and the relative displacement thereof.

The first element 15 is integral with the support frames 13 of the lenses 11.

The first element 15 in particular comprises a connecting bridge 14 for connecting the two frames 13 and preferably but not necessarily also comprises a reinforcing mesh 23 having annular parts that are congruent with the frames 13.

The first element 15 projects frontally of the front face of the frames 13 and in particular the reinforcing mesh 23 has a flat rear face positioned in a mark complementarily shaped thereto and located on the front face of the frames 13. In an embodiment shown in the drawings, the first element (15) is entirely located anteriorly, at every location along an entire length of the first element (15), of the two lenses (11), of the pair of support frames (13), and of the soft second element (12).

The second element 12 is formed by a seal comprising a pair of annular portions 16 for resting against the eye-sockets of the swimmer and a connecting bridge 24 between the annular portions 16.

The pair of annular portions 16 project posteriorly from the two support frames 13 of the lenses 11.

The connecting bridge 24, instead, is integral with the connecting bridge 14 from which it projects posteriorly so as to house the nasal root of the swimmer.

Special deposits of material can be included between the two connecting bridges 14, 24, which also facilitate the reciprocal mechanical grip there-between.

The distal ends of the two frames 13 have the engaging blocks 22 of the buckles (not illustrated) for regulating the strap of the goggles 10.

Advantageously, the first element 15, the second element 12 and the support frames 13 are each constituted by a different material.

By way of example, the frames 13 are made of elastomeric polypropylene having a modulus of elasticity (Young modulus) of 750 Mpa±10%, the first element (15), having a lower modulus of elasticity, is made of a thermoplastic rubber (TPE) having a hardness comprised between 60 and 80 Shore A, while the second element 12, which must be very soft in order to comfortably rest on the user's eye-sockets, is made of silicone or a thermoplastic rubber having a hardness comprised between 30 and 60 Shore A.

The assembly of the goggles can take place for example by multi-step moulding. In this case, in a first step the frames 13 are moulded onto the lenses 11 which perimetrally have small holes which are filled with the molten material of the frames 13 so as to facilitate the mechanical grip, and then the mould is rotated and the first element 15 is moulded on the front surface of the frames 13, and lastly the second element 12 is moulded on the rear surface of the frames 13 and on the rear surface of the connecting bridge 14 of the first element 15.

To summarise, according to the present invention the goggles, especially suitable for competitive swimming, are made of a multiplicity of elements that are distinct from one another and integral with one another, each of which, in order to carry out its specific function, is further made of a dedicated material.

The first element ensures maintenance of both the orientation of the relative lying planes of the two lenses and of the relative distance between the two lenses, notwithstanding the loads induced by the swimmer's movements, while the second element, intended for resting on the eye-sockets and the nasal root of the user, is made of a soft and elastic material.

The invention claimed is:

1. Swimming goggles (10) comprising:

two lenses (11);

a pair of rigid support frames (13) for supporting the lenses (11), said pair of rigid support frames (13) being separate and independent from the lenses (11), with each being formed by a ring of polypropylene elastomeric material congruent with a perimeter of the respective lens (11) for resting of the perimeter of the respective lens (11), said pair of rigid support frames (13) having a rigidity configured to ensure the shape of the perimeter of the lenses (11) and to support end buckles for connection between said goggles (10) and a support strap of said goggles (10);

a first element (15) for connecting said pair of rigid support frames (13) to one another, said first element (15) being separate and independent from said pair of rigid support frames (13) and comprising a first connecting bridge (14) located between said pair of support frames (13) and a reinforcing portion (23) extending along a front face of, and having annular parts that are congruent with, said pair of support frames (13), said first element (15) being made of a material having a lower rigidity than a rigidity of said pair of rigid support frames (13), said material configured to adapt said first element (15) to a shape of a user's nasal root but to oppose traction forces tending to modify a distance between the lenses (11) and torsional torques tending to modify relative lying planes of the two lenses (11); and a soft second element (12), separate and independent from the first element (15) and from said pair of rigid support frames (13), said soft second element (12) comprising a pair of annular portions (16) for resting against eye-sockets of the user and a second connecting bridge (24) between and connecting said pair of annular portions (16), said pair of annular portions (16) projecting posteriorly from the pair of support frames (13);

wherein said pair of support frames (13) are fastened to said second connecting bridge (24) between said pair of annular portions (16) of the soft second element (12);

wherein said first element (15) is entirely located anteriorly, at every location along an entire length of said first element (15), of said two lenses (11), of said pair of support frames (13), and of said soft second element (12);

wherein said first connecting bridge (14) is engaged directly to the second connecting bridge (24) between said pair of rigid support frames (13); and wherein said pair of support frames (13), said first element (15) and said second element (12) are integral with one another.

2. The swimming goggles of claim 1, wherein said pair of rigid support frames (13) for supporting the lenses (11) have a modulus of elasticity of 750 Mpa±10%.

3. The swimming goggles of claim 1, wherein said first element (15) is made of a thermoplastic rubber having a hardness comprised between 60 and 80 Shore A.

4. The swimming goggles of claim 1, wherein said soft second element (12) is made of silicone or a thermoplastic rubber having a hardness comprised between 30 and 60 Shore A.

* * * * *